United States Patent [19]

Ahroni

[11] Patent Number: 4,781,614

[45] **Date of Patent: * Nov. 1, 1988**

[54] ELECTRIC PLUG WITH SNAP-FITTED HOUSING COMPONENTS

[76] Inventor: Joseph M. Ahroni, 2701 W. Manor Pl., #204, Seattle, Wash. 98199

[ * ] Notice: The portion of the term of this patent subsequent to Jul. 7, 2004 has been disclaimed.

[21] Appl. No.: 42,292

[22] Filed: Apr. 24, 1987

Related U.S. Application Data

[62] Division of Ser. No. 755,230, Jul. 17, 1985, Pat. No. 4,679,877.

[51] Int. Cl.[4] ..... H01R 4/24; H01R 19/04

[52] U.S. Cl. ..... 439/391; 439/696

[58] Field of Search ..... 439/391, 597–601, 439/621, 622, 686, 687, 695, 696, 701

[56] References Cited

U.S. PATENT DOCUMENTS

| | | | |
|---|---|---|---|
| 1,956,409 | 4/1934 | Benander | 439/687 |
| 4,029,896 | 6/1977 | Skinner | 439/457 |
| 4,108,527 | 8/1978 | Douty et al. | 439/465 |
| 4,178,061 | 12/1979 | Ahroni | 439/622 |
| 4,274,698 | 6/1981 | Ahroni | 439/622 |
| 4,443,050 | 4/1984 | Taylor | 439/620 |
| 4,678,257 | 7/1987 | Ahroni | 439/686 |

*Primary Examiner*—Gil Weidenfeld
*Assistant Examiner*—Gary F. Paumen
*Attorney, Agent, or Firm*—Seed and Berry

[57] ABSTRACT

An electric plug has registering housing shells which interlock when pressed together by way of flexible legs with locking feet on one of the shells which pass through passages in the other shell. These legs deflect while the feet pass through the passages whereupon the legs spring back causing the feet to snap into locking position. The housing shells present a wireway into which contact barbs and a cord piercing and spreading prong project to respectively make electrical contact with the wire leads in an insulated cord in the wireway and to pass through and clamp the cord against outwardly curved side wall portions of the wireway while the housing shells are being pressed together.

11 Claims, 7 Drawing Sheets

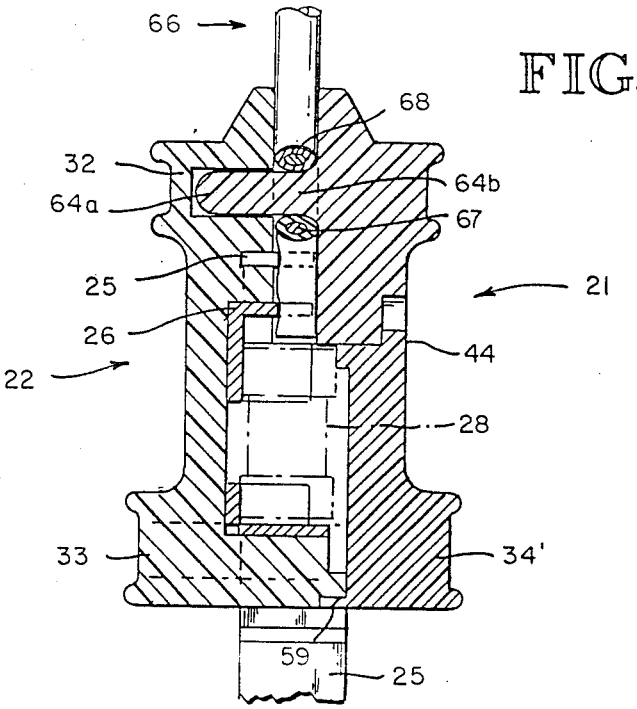
FIG. 8
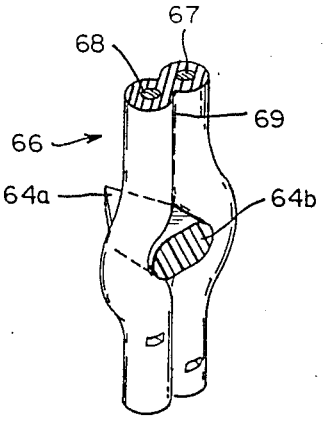
FIG. 9
FIG. 10
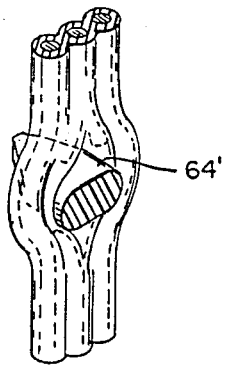

ELECTRIC PLUG WITH SNAP-FITTED HOUSING COMPONENTS

This application is a division of U.S. patent application Ser. No. 755,230, filed July 17, 1985, now U.S. Pat. No. 4,679,877.

TECHNICAL FIELD

The present invention relates to plugs fitted to the ends of electrical cords for connection with other plugs or electrical outlets.

BACKGROUND ART

This invention is an improvement over the plug with snap-fitted housing shells shown in my prior U.S. Pat. No. 4,274,698. That plug had corner positioning dowels and flexible longitudinal positioning lands presented by one of two mating housing shells, and had corner dowel receiving holes and undercut matching longitudinal recesses in the other housing shells. As the housing shells were pressed together with the dowels registering with the holes, the lands were intended to flex laterally sufficiently to snap fit into the undercut recesses. However, considerable difficulty was experienced in making injection molds which would result in plastic elements giving proper operation of the snap fitting feature and which would firmly hold the two housing shells together after assembly of the plug. Also, the insulated wire leads for the plug had to have their ends stripped of insulation and connected to contact elements which was time consuming. A further difficulty experienced in electrical plugs having two interfitting housing shells in providing adequate resistance (strain relief) to pulling of the wire leads free of the plug housing.

The present invention aims to overcome these difficulties and to provide an improved plug of unusually simple and economical construction with a minimum of parts which can be quickly assembled without auxiliary fastenings and without need to strip insulation from the wire leads before assembly of the plug.

DISCLOSURE OF INVENTION

In accordance with this invention two injection-molded housing shells which collectively provide a wireway are snap-fitted together by way of flexible legs projecting from one of the shells and passing through the other shell to interfit feet on the legs with locking shoulders presented by the other shell. While the two housing shells are being pressed together an integral prong projecting from one of the shells in the wireway is forced completely through the insulation separating two wire leads in a cord positioned in the wireway. As a result the wire leads and surrounding insulation are forced apart on opposite sides of the prong and are squeezed against outwardly curved walls presented by one of the shells so as to strongly resist separation of the cord and plug. Also, as the housing shells are pressed together, contact barbs projecting into the wireway from contact members are forced through the cord insulation into engagement with the wire leads.

Accordingly, pressing of the housing shells together accomplishes interlocking of the shells, clamping of the cord to the housing, and making electrical contact with the cord leads.

In one embodiment the plug has externally projecting contact blades, one of which is fused, and in another embodiment the plug is a socket type for receiving plug blades. In the detailed description the first embodiment is referred to as an attachment plug and the second embodiment is referred to as a connector plug.

BRIEF DESCRIPTION OF THE DRAWINGS

FIG. 8 is a vertical sectional view taken through an assembled attachment plug and taken as indicated by line 8—8 in FIG. 4.

FIG. 9 is a detailed perspective view illustrating the action of the piercing and spreading prong with a cord having two wire leads.

FIG. 10 is a detailed perspective view illustrating the action of the piercing and spreading prong with a cord having three wire leads.

BEST MODE FOR CARRYING OUT THE INVENTION

Figure 1:
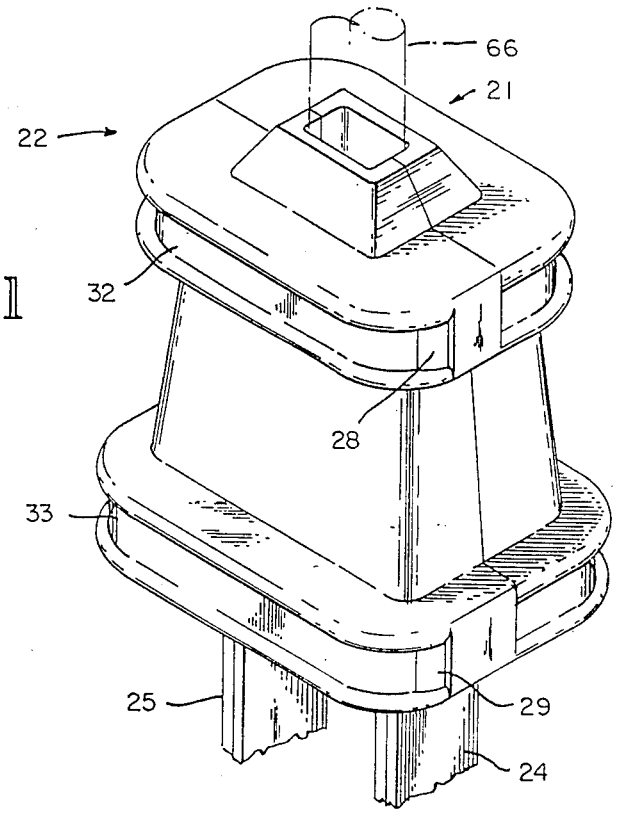
FIG. 1 is a rear perspective view of a fused attachment plug embodiment of the invention.
Figure 2:
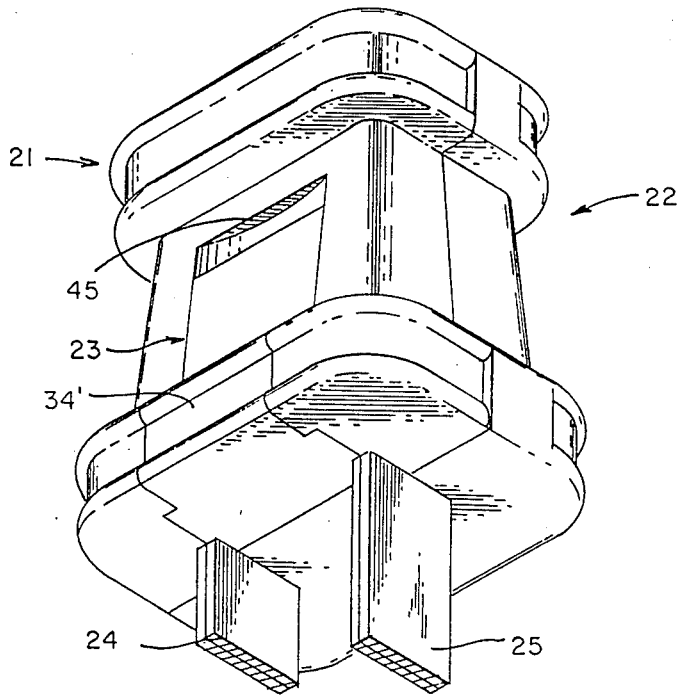
FIG. 2 is a front perspective view of the attachment plug.
Figure 3:
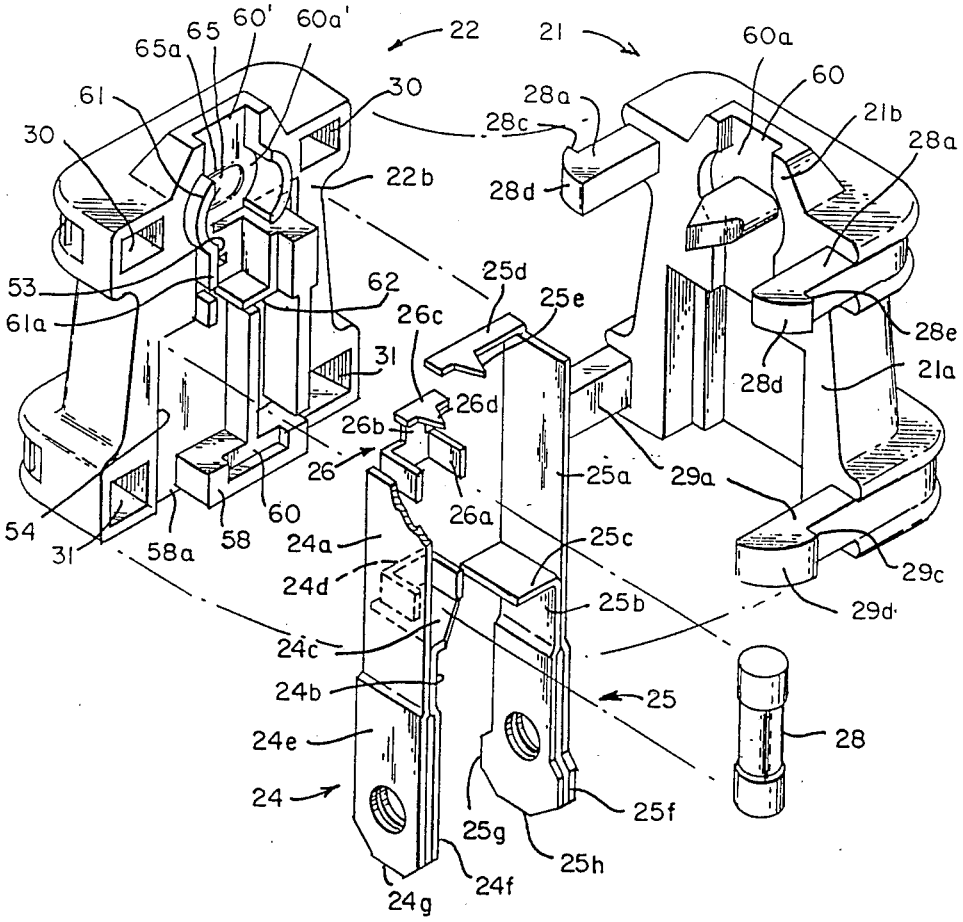
FIG. 3 is an exploded perspective view of the parts of the attachment plug.
Figure 4:
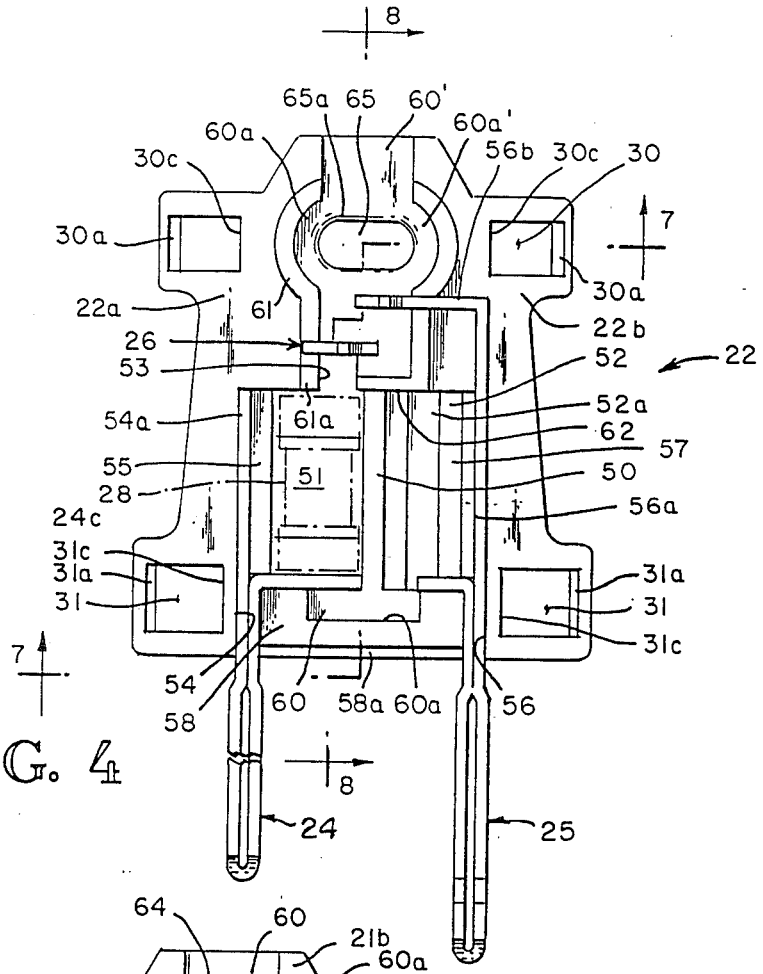
FIG. 4 is a top plan view of the female housing shell of the attachment plug with the blades mounted therein and showing the fuse.
Figure 5:
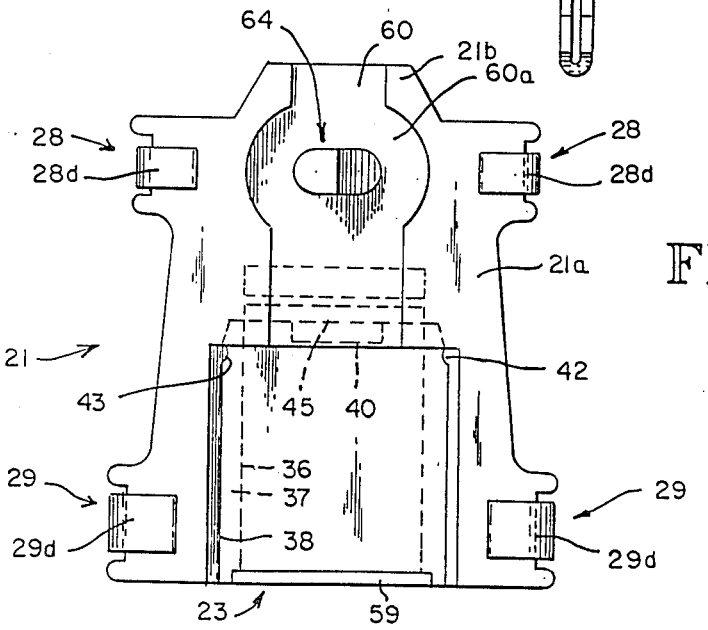
FIG. 5 is a bottom plan view of the male housing shell.
Figure 6:
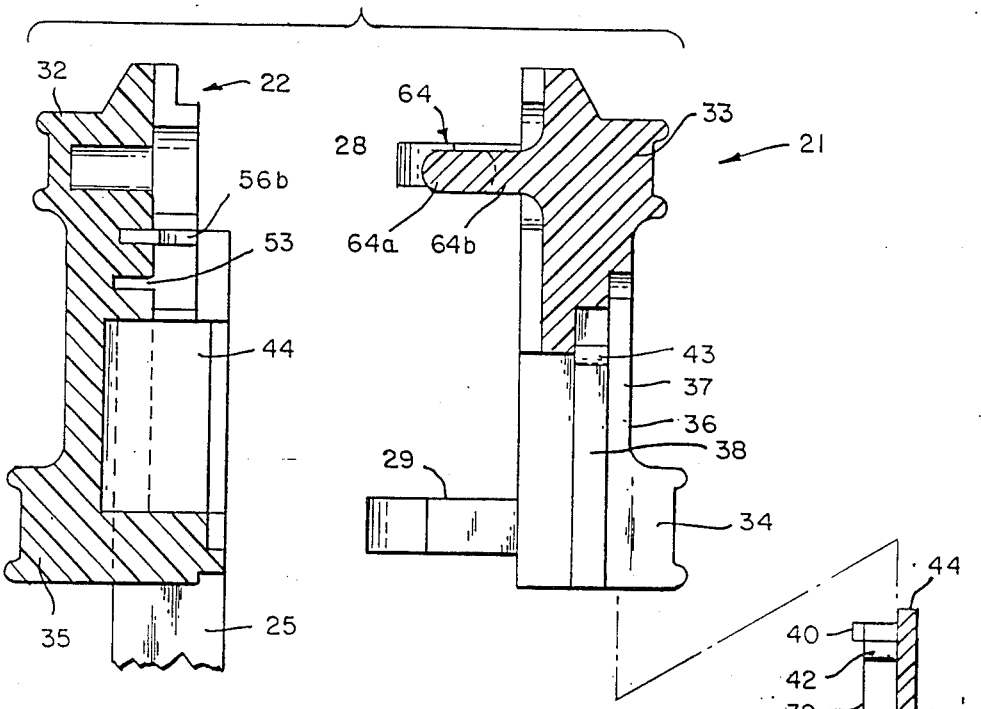
FIG. 6 is an exploded view showing the male and female housing shells in vertical section along the longitudinal center line and in alignment with one another, and showing the door in elevation.
Figure 7:
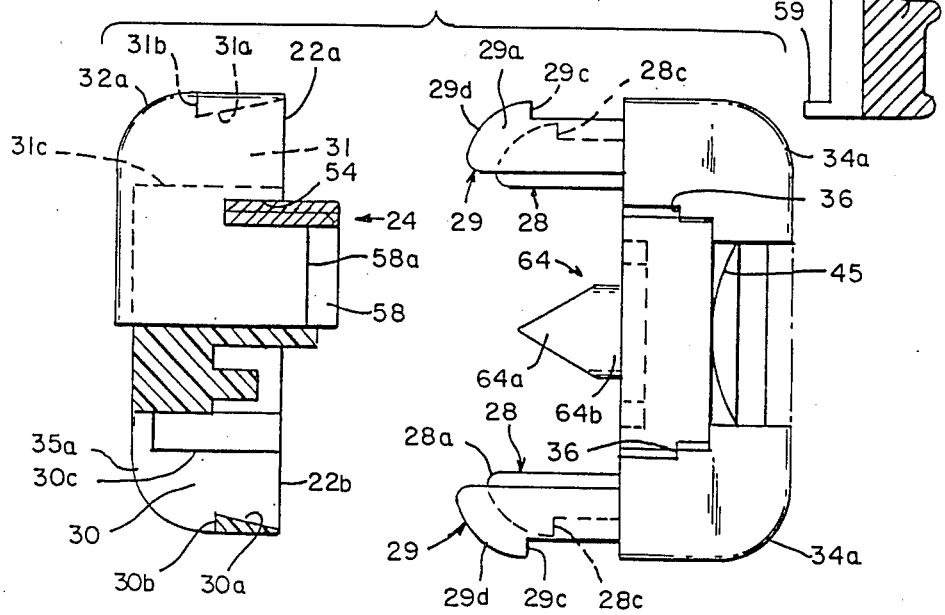
FIG. 7 is an exploded view of the female and male housing shells in alignment with part of the female shell in transverse section.

Referring to the drawings it is seen that two types of plugs are shown in the drawings; one is an attachment plug (FIGS. 1–8) with projecting blades for insertion in a wall outlet or other socket unit, and the other is a connector plug functioning as a socket unit for receiving the blades of an attachment plug. An extension cord, for example, normally has an attachment plug at one end for making a power connection and has a connector plug at the other end for receiving the attachment plug of a lamp, heater, tool or appliance. For purposes of this description and the appended claims, both the attachment plug and the connector plug are designated as a "plug," it being recognized that commonly a connector plug is also called a socket.

The plugs of this invention have three particular features in common; each has two mating housing shells having a snap interfit, each has a novel strain relief arrangement for the cord connection to the plug to resist separation of the plug and the related cord, and each makes electrical connection with the cord responsive to snap fitting the housing shells together without requiring prestripping of the cord insulation in the area of electrical contact.

The enabling structure for these features will first be described for the attachment plug, and more particularly to a fused attachment plug. The parts for this plug comprise male and female housing shells 21–22, a fuse access door 23, two blade members 24–25, and a contact member 26. For purposes of example the plug has been adapted for use with a cylindrical fuse 28 of the common type having a cylindrical non-conductive body 28*a*, a pair of conductor end caps 28*b*, and a fuse element in the body 28*a* connected to the end caps. In describing the attachment plug the cord receiving end will be referred to as the "head" end, and the end from which the blade members 24–25 project will be referred to as the "foot" end. The door 23 slide fits with the male shell 21 from the foot end thereof, and for purposes of this description the door side of the plug will be called the front side. With this in mind, the side of the male shell 21 facing the female shell 22 will be called the back side of the male shell, and the side of the female shell facing the front of the plug will be called the front side of the female shell.

Snap fitting of the housing shells 21–22 together is accomplished by way of a head pair 28 and a foot pair 29 of rearwardly projecting legs with respective outwardly extending locking feet 28*a*, 29*a* which fit into pairs of tapered passages 30 and 31 at the head and foot of the female shell 22. These passages have their outer walls 30*a*, 31*a* tapered inwardly from the front side of the female shell, and they terminate at locking shoulders 30*b*, 31*b* which are spaced from the inner walls 30*c*, 31*c* of the passages 30, 31 a distance slightly greater than the maximum width of the locking feet 28*a*, 29*a*. These feet have a front locking step 28*c*, 29*c* at their juncture with the legs 28, 29 and curved cam bottoms 28*d*, 29*d*. When the housing shells 21, 22 are in perfect front to back alignment, the inner edges of the locking steps 28*c*, 29*c*, where they join the legs 28, 29, are aligned with the back edges of the outer walls 30*a*, 31*a* of the passages 30, 31 where they join the locking steps 28*c*, 29*c*. Hence, in order for the locking legs 28, 29 to move through the passages 30, 31 they must flex inwardly so that the outer edges of the locking steps 28*c*, 29*c* (the toes of feet 28, 29) can clear the juncture of the outer walls 30*a*, 31*a* of the passages 30, 31 with the locking shoulders 30*b*, 31*b*. Then the legs are free to flex outwardly again to substantially their initial relaxed position, thereby engaging the locking steps 28*c*, 29*c* with the locking shoulders 30*b*, 31*b*.

It will be noted that the housing shells 21–22 have matching head and foot peripheral ribs 32, 33 (head) and 34, 35 (foot) which are indented to give a channel-like configuration. The channels formed by the ribs 33 and 35 on the female shell 22 are intersected by the passges 30, 31. At these junctures the outer edges 33*a*, 35*a* of the ribs 33, 35 are curved, and this curvature is matched by the curvature at the bottoms of the locking feet 28*a*, 29*a* so that the latter are substantially flush with the curved outer edges 33*a*, 35*a* when the housing shells 21, 22 are interfitted. The curvature of the outer edges of the ribs 32, 34 in the male shell 21 is made the same as that of the ribs 33, 35 in the female shell so that collectively they have a symetrical unitary appearance. The ribs 32–33 and 34–35 are useful for manual gripping of the plug housing as well as shielding the pairs of locking feet 28, 29 and obscuring their presence after assembly of the attachment plug.

To receive the fuse access door 23 the male shell 21 has a front rectangular opening extending from the foot end. The male shell 21 has a stepped undercut at the back along the longitudinal side edges 36 of the door opening to provide a pair of door retaining shoulders 37 and a pair of adjoining guideways 38 to receive retaining flanges 39 along the corresponding sides of the door 23. The handle 34' for the door provides a continuation of the rib 34 at the foot of the male shell 21. At the underside of its forward end the door has a stop flange 40 arranged to resist complete withdrawal of the door. Matching indents 42 in the sides of the door and nipples 43 in the guideway 38 give a snap fit to the door when it is closed. When the door is in closed position a front lip 44 overlies a dished recess 45 in the foot end face of the male shell 21.

The female shell 22 is recessed in a pattern to receive the blades 24–25 and the contact member 26. Blade 24, which will be referred to as the fused blade, has an outer straight section 24*a* overlapped part way of its length by an inner straight section 24*b* which bends inwardly at its head end to form a right angle bracket 24*c*. At the lower end of this bracket the blade 24 bends forwardly and is formed into a fuse channel 24*d* having an open front end and top. The rear end of the straight blade sections 24*a*, 24*b* jog outwardly slightly to merge with plug-in portions 24*e*, 24*f* which join at a bend 24*g*.

The other blade 25, which will be referred to as the polarized blade, has a relatively long straight section 25*a* opposed a minor part of its length by an inner straight section 25*b* which is bent at ita forward end inwardly to form a stabilizing flange 25*c*. The outer straight section 25*a* is bent inwardly and narrowed at its forward end to form a contact section 25*d* having a pointed piercing barb 25*e*. At their rear end the straight sections 25*a*, 25*b* jog outwardly slightly to merge with plug-in portions 25*f*, 25*g* which join at a bend 25*h*. Adjoining this bend 25*h* the plug-in portions 25*f*, 25*g* are widened as is conventional for a polarized blade.

The contact member 26 provides a fuse channel 26*a* at its foot end complementing the fuse channel 24*d*, has a relatively short flat intermediate section 26*b*, and has a contact section 26*c* at its head end formed with an upper piercing barb 26*d*.

It will be noted that the female shell 22 has a central generally rectangular cavity area at the top divided by a central baffle 50 into a live fuse chamber 51 and a fuse storage chamber 52 which has a raised floor section 52*a*. Joining the head end of the live fuse chamber 51 is a generally T-shaped extension 53, and joining the outer rear corner of chamber 51 is an entry chamber 54. The latter opens to the foot of the housing 22 and has a narrowed forward extension 54*a* separated by a wall 55 from the cavity 51. Similarly, the fuse storage chamber 52*a* is joined at its outer rear corner by an entry chamber 56 having a narrowed forward extension 56*a* separated by a wall 57 from the cavity 52. The extension 56*a* extends forwardly further than extension 54*a*, and then has a right angle bend inwardly to form a terminal extension 56*b*.

When the attachment plug is assembled the blades 24, 25 and contact member 26 fit within the female shell 22. The contact member 26 is positioned with its front contact section 26*c* in the arms of the T-shaped chamber extension 53 and its intermediate section 26*b* resting on the floor of the leg portion of the chamber extension 53. This arrangement positions the fuse channel portion 26*a* of contact member 26 centered at the head of live fuse chamber 51.

Fused blade 24 is positioned in the female shell 22 with its outer straight section 24*a* housed in the entry 54 and entry extension 54*a*, and with the inner straight section 24*b* positioned in the entry 54 so that the bracket 24c extends into the rear of the live fuse chamber 51. This positions the fuse channel 24d opposite fuse channel 26a and positions plug-in portions 24e, 24f in rearwardly projecting relation to the female shell 22.

Polarity blade 25 is positioned in the female shell 22 with its outer straight section 25a housed in the entry 56 and entry extension 56a, and with the inner straight section 25b positioned in the entry 56, so that the stabilizing flange 25c enters the outer rear corner portion of the fuse storage chamber 52a and the contact section 25d occupies the terminal extension 56b. This positions plug-in portions 25f, 25g in rearwardly projecting relation to the female shell 22 and parallel to the corresponding portions 24e, 24f of the fused blade 24.

It will be noted that the walls 55, 57 of the female shell project upwardly above planar flat upper faces 22a, 22b to the extent that the distance from the bottom of the entry extension recesses 54a, 56a to the top of the walls 55, 57 matches the width of the straight sections 24a, 25a of the blades 24, 25. In this regard, the rear end wall of the female shell 22 has a central upward extension 58 between the entries 54, 56 which extends upwardly to the level of the top of the walls 55, 57. The rear extension 58 has a rear step 58a which is matched by a rear lip 59 on the underside of the door 23, and has a central recess 60 with a bottom face merging with the upper face of the divider wall 50. The back wall 60a of the recess 60 is engaged by the stop flange 40 of the door 23 when the door is open.

At their head end the housing shells 21, 22 have nose portions 21b, 22b which are longitudinally recessed to provide the top and bottom halves 60, 60' of a wireway having a central bulge 60a, 60a' at both sides. The central bulge in the female shell 22 is bordered on both sides by upwardly and then projecting wire confining walls 61 which curve outwardly and then continue rearwardly by a straight section 61a intersected by the terminal extension slot 56b and T-shaped recess 53. The straight section opposite the spare fuse cavity 52 has a right-angle extension 62 to serve as a wire stop. The walls 61 are sized to fit into the bulge portions 60a of the top half of the wireway provided by male shell 21.

Centered in the bulge portion of the wireway lower half 60 in the male shell 21 is a piercing and spreading prong 64 which projects downwardly beyond the bottom face 21a of the male shell to fit within a well 65 in the female shell 22. This well 65 preferably has a tapered entry portion 65a. The prong 65 has a tapered piercing and spreading portion 64a which fits within the well 62 and preferably has a straight root end portion 64b extending for about the thickness of the wireway 60–60' to perform a wire spreading function. Although other shapes are suitable, it is preferred to give the prong 64 and well 65 an elliptical cross-section with the minor axis along the longitudinal center axis of the male shell 21. The curve of the well is concentrically matched by the curve of the wire confining 61.

To assemble the attachment plug, the blades 24, 25 and contact member 26 are first positioned in the male shell 22. When so positioned the straight section 24a of blade 24 occupies the outer half of the entryway 54 and the entire entryway extension 54a, the shorter straight section occupies the inner half of entryway 54, and the bracket portion 24c and fuse channel 24d are positioned at the rear of the fuse receiving cavity 51. Plug-in portions 24e, 24f then project from the rear of the shell 22.

The polarized blade 25 is positioned with its straight section 25a in the outer half of entryway 56 and the entire entryway extension 56a, the shorter straight section in the inner half of the entryway 56, the stabilizing flange 25c in the extreme rear of the fuse storage chamber 52, and the contact section in the entryway right-angle extension 56b. When the blade 25 is so positioned in the female shell 22 the piercing barb 25c projects upwardly well into the wireway portion 60', and the plug-in portions 25f, 25g project rearwardly from the shell 24.

The interfit of the blades 24, 25 with the female shell 22 is a snug fit and keeps the rearwardly projecting plug-in portions of the blades from rocking relative to the plug housing. The engagement of the rear face of the bracket portion 24c of blade 24 with the rear wall of the fuse chamber 51, and the engagement of the rear face of the stabilizing flange 25c of blade 25 with the rear wall of the fuse storage chamber 52, assist in resisting spreading of the blades apart at the rear of the plug housing.

The contact member 26 is positioned with its contact section 26c at the front of the T-shaped chamber 53 and interfitting with the arm portions thereof, and with the central section 26b of the contact member resting on the floor of the leg portion of the chamber 53. This places the fuse channel portion 26a in the head end of the active fuse chamber 51 in alignment with the fuse channel portion 24d of blade 24 and locates the piercing barb 26d so that it projects upwardly into the wireway portion 60' to the same level as piercing barb 25e.

The female shall is then ready to receive an electrical cord 66 having a pair of wire leads 67, 68 enclosed and separated by insulation 69, preparatory to fitting the male and female shells together. The end portion of the cord to which the plug is to be applied is centered over the wireway 60' so that it extends therealong to the extent that the end of the cord abuts the stop wall 62. This places leads 67, 68 directly over piercing barbs 25e and 26d, respectively. Then the male shell 21 is aligned with the female shell 22 with the pairs of locking feet 28a, 29a registering with the mouths of the passages 30, 31 in the female shell. This locates the prong 64 in alignment with the well 65.

The two shells 21, 22 are then pressed together until the locking steps 28c, 29c at the top of the locking feet 28a, 29a engage the locking shoulders 30b, 31b to lock the shells together as a unit. While the shells 21, 22 are being pressed together the barbs 25e, 26d pierce the cord insulation 69 and are brought into direct contact with the wire leads 67, 68. At the same time the prong 64 punches completely through a central portion of the insulation 69 and has its tapered portion 64a enter the well 65.

While the prong 64 is passing through the insulation 69 it spreads the wire leads 67, 68 and surrounding insulation apart adjoining the hole through the insulation made by the prong 64, thereby creating two oppositely curved branches of the cord separated by the root portion 64b of the prong as indicated in FIG. 9. These two branches are forced laterally outward by the prong into firm engagement with the opposed faces of the two wire confining walls 61. As a result, the cord 66 is clamped in position by the squeezing action of the prong 64 and walls 61 to keep the cord from pulling free of the plug housing. Separation of the cord from the plug housing is also resisted by the interfit of the prong 64 and the cord; in order for the cord to be pulled free of the prong 64, the portion of the cord insulation 69 between the prong and the adjacent end of the cord would have to tear through completely along its length. It is significant that the clamping of portions of the cord 66 between the prong 64 and the walls 61 does not result in residual forces tending to push the housing shells 21, 22 apart.

In some instances such as in a series-parallel lighting set such as shown in my pending application Ser. No. 664,153, filed Oct. 24, 1984 now U.S. Pat. No. 4,631,650, it is preferred to have a three-lead cord 66 enter the plug housing, but not have the center lead make electrical connection within the plug. In such a case the prong is shaped to completely sever the center lead 66'a as indicated for prong 64' in FIG. 10, as the prong passes through the cord and presses the remainder of the adjoining portions of the cord laterally outward against the confining walls 61.

When the attachment plug has been assembled the door 23 can be opened by pulling on the handle 34' to give access to the chamber 51 for application of a fuse 28 so that it seats in the contact channels 24d, 26a to complete the circuit between the contact member 26 and the blade 28, and for placing a spare fuse in chamber 52. Although cylindrical fuses 28 have been illustrated as used in the attachment plug, it is to be understood that other types of fuses can be used such, for example, as those shown in U.S. Pat. No. 4,274,698.

Figure 11:
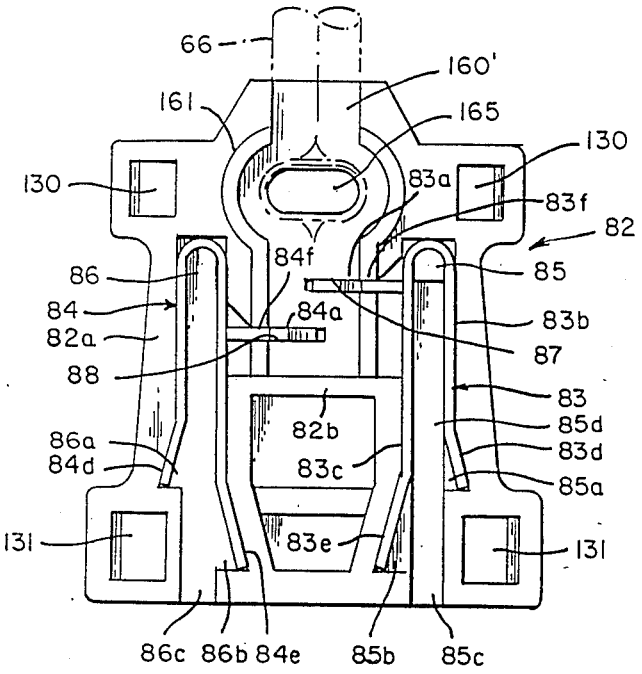
FIG. 11 is a front plan view of the female housing shell with conductor members in place for a connector plug embodying the present invention.
Figure 12:
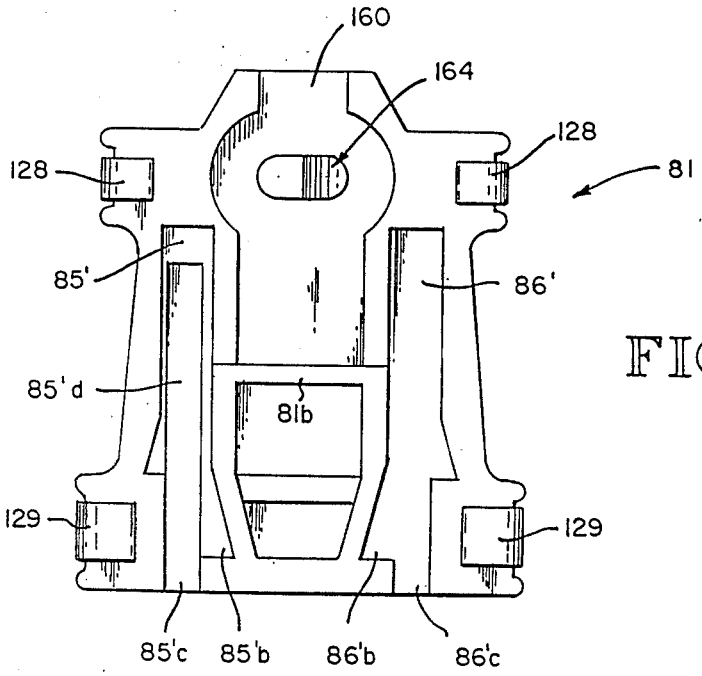
FIG. 12 is a bottom plan view of the male housing shell for the connector plug.
Figure 13:
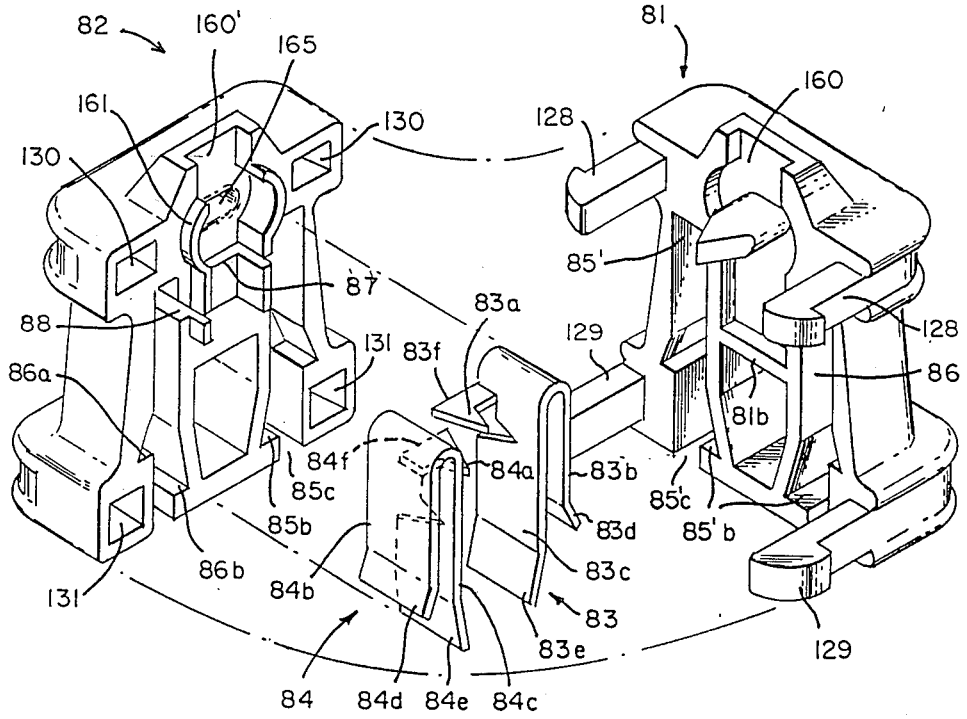
FIG. 13 is an exploded perspective view of the parts for the connector plug.

Attention is now directed to the connector plug shown in FIGS. 11–13. It will be noted that the housing for the connector plug has the same general external configuration as the housing for the attachment plug, except that no door is provided because the connector plug is not fused. Bottom tabs may be provided to prevent use of the end connector with a three-bladed, grounded plug. The connector plug has the same arragnement as the attachment plug for snap fitting the male and female housing shells 81, 82 of the connector plug together and for preventing separation of the cord from the plug; hence, corresponding parts in the connector plug and attachment plug will be given the same identifying numerals except that those for the connector plug will be increased by 100. The description for these corresponding parts will not be repeated.

The connector plug has two contact members 83, 84 which make electrical contact with the cord leads by way of piercing barbs 83a, 84a in the same manner as the barbs 25e and 26d in the attachment plug. Contact member 83 is generally U-shaped by way of an outer arm 83b and a longer inner arm 83c joined at the head end. Arm 83b flares outwardly at the rear by an entry portion 83 and arm 83c flares away from arm 83b by an entry portion 82e. The barb 83z extends upwardly from a wing 83f which is struck from the arm 83c and then bent away from arm 83b at right angles. The other contact member 84 is asymmetrical with reltion to contact member 83 except that the wing 84f from which the barb 84a extends is further from the head end of contact member 84 than the wing 83f is from the head end of contact member 83.

For housing the lower half of the contact members 83, 84 the female shell 82 has asymmetrical longitudinal cavities 85, 86 with outwardly flared offsets 85a, 86a and inwardly flared offsets 85b, 86b which are closer to the rear of the shell. Blade entry slots 85c, 86c in the rear wall of the shell connect with the cavities 85, 86. The cavities 85, 86 also have right-angle branches 87, 88 which extend into the wireway 160'.

The male shell 81 has asymmetrical cavities 85', 86' with entries 85'c and 86'c which are the same shape as cavities 85, 86 in the female shell. It will be noted that a major part of the floors of cavities 85, 85' have longitudinal recesses 85d, 85'd extending through the entries 85c, 85'c to provide sufficient collective depth when the shells are snap-fitted together to receive the enlarged end of a polarized blade such as blade 25.

The connector plug is assembled in the same manner as the attachment plug. First the contact members 83, 84 are positioned in the cavities 85, 86 of the female shell 82 with the wings 83f, 84f in the right-angle branches 87, 88 thereof and the flared portions 83d, 84d and 83e, 84e of the contact members fitting into the flared offsets 85a, 86a and 85b, 86b, respectively, of the cavities 85, 86. When the contact members 83, 84 are in the described position in the female shell 82, half the width of the contact members projects above the flat upper face portion 82a of the shell and the piercing barbs 83a, 84a project above the floor of the wireway 160'. A cord 66 is then positioned in the wireway 160' with its end agianst a transverse wall portion 82b which extends upwardly to the level of upper face 82a. Finally, the male shell 81 is placed in registration with the female shell 82 and the two shells are pressed together until the locking feet 28a, 29a are in locking position in the same manner as previously described respecting the attachment plug. While the shells 81, 82 are being pressed together the prong 164 passes through the cord insulation 69 and functions together with the confining walls 161 to clamp the cord and prevent separation of the cord and plug housing in the same manner as previously described. Likewise, while the housing shells 81, 82 are being pressed together the barbs 83a, 84a are forced through the cord insulation 69 to make electrical contact with the wire leads 67, 68.

It will be appreciated that the housing shells 21, 22 and door 23 of the attachment plug, and the housing shells 81, 82 of the connector plug, are shaped and adapted to be injection molded of a suitable plastic. The blades 24, 25 and contact members 26 of the attachment plug, and the contact members 83, 84 of the connector plug are shaped to be punched and formed as unitary parts from brass strips.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. An electrical plug comprising:

a housing having two interfitting housing shells providing a wireway open at one end for entry of two insulated conductors;

two pairs of flexible legs projecting integrally from one of said shells near opposite ends thereof, each leg having an integral locking foot at its free end extending laterally outward, said legs extending through bores formed in the other shell and having their locking feet engaging retaining shoulders at the outer ends of the bores to prevent withdrawal of the legs from the bores;

each of said bores having a widened mouth portion at its inner end aligned with the respective retaining shoulder for introduction of the locking foot of the respective leg at the start of assembly of the housing, and then tapering inwardly from said mouth portion such as to spring the leg laterally inward during assembly until its locking foot reaches the outer end of the bore and springs back outwardly to fit over the respective retaining shoulder, said legs being hidden in said bores and said shoulders being substantially covered by said locking feet; and two conductive members located in the housing and having insulation-piercing elements projecting into said wireway and arranged to pierce the insulation surrounding said conductors and engage respective ones of said conductors when the housing shells are pressed together with said legs in said bores.

2. An electrical plug according to claim 1 in which the shell with the bores has a central cavity between the inner ends of the legs for receiving a fuse and the shell with the legs has a door giving access to the central cavity.

3. An electrical plug according to claim 1 in which the shells have peripheral, parallel ribs at their opposite ends and the bores extend through the ribs of the shell having the bores.

4. An electrical plug according to claim 3 in which the ribs have a channel-like configuration and the bottom of the channel of each rib of the shell which has the bores is intersected by the respective bores and is bridged at the outer side of such bores to provide the retaining shoulders.

5. An electrical plug according to claim 3 in which one of the shells has a door opening interrupting the rib at one of its ends, and has a door with a rib portion filling said interruption when the door is closed.

6. An electrical plug according to claim 3 in which the ribs have a channel-like configuration and the locking feet are confined within the ribs.

7. An electrical plug according to claim 1 in which the shells have peripheral channels at their opposite ends into which the bores extend, said locking feet being confined within the channels.

8. An electrical plug according to claim 1 in which two conductor blades project from said housing and are conductively connected to respective ones of said conductor members.

9. An electrical plug according to claim 1 in which said conductor members have generally U-shaped portions aligned with two socket entries into the housing to receive plug blades.

10. An electrical plug according to claim 1 in which two blade members in the housing present two conductor blades projecting from the housing, one of said blade members being integral with one of said conductor members; and a fuse in the housing electrically connecting the other of said blade members with the other of said conductor members.

11. An electrical according to claim 10 in which said fuse is located in a fuse chamber in one of said shells and the other shell has a door for giving access to the fuse chamber.

* * * * *